US007461612B1

(12) United States Patent
Houck

(10) Patent No.: US 7,461,612 B1
(45) Date of Patent: Dec. 9, 2008

(54) DUAL HULL KAYAK

(76) Inventor: Patrick D. Houck, 19442 Coral Wood La., Huntington Beach, CA (US) 92646-2600

( * ) Notice: Subject to any disclaimer, the term of this patent is extended or adjusted under 35 U.S.C. 154(b) by 0 days.

(21) Appl. No.: 11/890,983

(22) Filed: Aug. 8, 2007

(51) Int. Cl.
*B63B 35/00* (2006.01)

(52) U.S. Cl. ..... 114/347; 114/357

(58) Field of Classification Search ..... 114/357, 114/347, 61.24, 61.22
See application file for complete search history.

(56) References Cited

U.S. PATENT DOCUMENTS 4,400,425 A * 8/1983 Vanha ..... 442/224
4,627,373 A * 12/1986 Nishida ..... 114/182
5,061,215 A * 10/1991 Walls ..... 441/45
5,870,966 A * 2/1999 Christian ..... 114/353
6,871,608 B2 * 3/2005 Rosen ..... 114/61.1
D566,644 S * 4/2008 Houck ..... D12/302

* cited by examiner

*Primary Examiner*—Stephen Avila
(74) *Attorney, Agent, or Firm*—Clement + Cheng

(57) ABSTRACT

The present invention is a dual hull kayak that has a right pontoon that is substantially hollow and having a right forward end and a right rear end so that in ordinary buoyancy the right pontoon substantially supports the dual hull kayak from the right forward end to the right rear end. Also, a left pontoon that is substantially hollow and having a left forward end and a left rear end allows in ordinary buoyancy the left pontoon to substantially support the dual hull kayak from the left forward and to the left rear end. A bridge arch is formed between and joins the right pontoon and left pontoon. The bridge arch further comprises a shallow depression for supporting a user.

16 Claims, 4 Drawing Sheets

DUAL HULL KAYAK

DISCUSSION OF RELATED ART

Kayaks, developed over hundreds of years ago, were originally made from wood, whalebone, or driftwood. Typically, fir, pine, spruce and willow were used for wood frame construction. Sinews were used to lash the frame and sew the skins, while animal skins, particularly seal skin, served as a covering for the kayak. Particularly, the seal skins, hairs removed, were sewn onto the wooden frame and were waterproof as they were cured with oil. Because the stitches did not completely pass through the animal skin, the seams were waterproof as well. The kayak originated in the artic regions of Asia, North America, and Greenland. While the natives of these regions designed various types of kayaks, dependent upon the resources available to them and their culture, the kayaks had the same purpose of hunting animals across the vast artic waters. In fact, to imitate a drifting block of ice, a white cloth would be strung over the front of the kayak. The word "kayak" essentially means "hunter's boat." Kayaks were also used for transportation across the waters. Kayaks would be filled with enough supplies to last the natives for an extended period of time for hunting trips across the harsh artic environment.

The "umiak", or "baydar", is essentially an open-decked boat made with seal skins and wood. It was once thought that the kayaks evolved from the umiak. The paddles were single-bladed, but there was usually more than one paddler. These kayaks ranged from about 17 feet to about 60 feet. Because some nomadic native groups followed animal migrations, these kayaks were particularly useful in the transportation of household goods, the elderly, children, and those unable to paddle.

The Alaskan Aleuts developed the double and triple kayaks known as a "baidarka." This was also used for hunting expeditions and transportation. The triple kayak was used to transport missionaries. Some have contemplated that the triples appeared after the Europeans appeared. It was thought that the Alaskan Aleuts were forced by the Russians to make a third hull so that the Russians would not have to paddle.

Gradually over time, news of these kayaks traveled to Europe. Kayaks in France and Germany were used for recreational purposes. Because these countries have mountainous ranges, the plunging rivers flowing out of the rocky slops offered challenging rapids.

The difference between a modern kayak, which is mostly used for recreation, and a traditional kayak, which is typically used for hunting animals, is in the materials that are used to build them. It is important to note that because of the obvious change in kayak usage, there are also fundamental changes to the boat design and its equipment. Of course, because of the advancements in the designing and altering of the kayak, the modern kayak has additional safety features, including bulkheads and hatches. Nonetheless, a majority of the features found in the modern hull designs can be seen in the traditional kayak hull designs. Also, instead of using animal skins as a covering, modern kayaks now use waterproofed canvas.

Modern sea kayaks are composed of various, specialized types of kayaks. There are at least six major types, each further classified into additional kinds. They are "Sea kayaks," "Whitewater kayaks," "Surf kayaks," "Racing kayaks," "Specialty and multi-type kayaks," "Fishing kayaks," and "Standing kayaks." Most modern kayaks are constructed from wood, rotomolded plastic, fabrics over wooden or aluminum frames, fiberglass, Kevlar, or carbon fiber. A majority of these modern kayaks allow one or two paddlers, but there are some special-purpose boats that may accommodate more. Sea Kayaks generally have a longer waterline, which emphasizes "straight travel through the water over extreme maneuverability," and provisions for below-deck storage of cargo.

Kayaking has been a popular pastime for divers, fishermen and outdoor enthusiasts. Kayaking allows individuals to explore nature in highly maneuverable watercraft. Unfortunately, the traditional kayak has been difficult to maneuver because of a steep learning curve. Beginners have often tipped over because of unfamiliarity with kayak steering and handling. A variety of dual hulled kayaks have provided additional stability, but have introduced other disadvantages.

A variety of kayaks have been implemented on the waterways of North America including dual hull kayaks. The dual hull kayaks typically have an elongated molded body of a continuous outer membrane that covers an internal cavity. Lekhtman in U.S. Pat. No. 6,112,692, the disclosure of which is incorporated herein by reference, discloses a dual hull kayak having a bridge platform over a pair of lateral spaced pontoons. Other dual hull inventions include a Marine Catamaran platform as shown by Sanchez in U.S. Pat. No. 7,013,819. The Sanchez disclosure shows that the substantially identical hulls are mounted together by beams.

Rosen in the U.S. Pat. No. 6,871,608 incorporated herein by reference provides a twin hull personal watercraft that allows a human user to have a variety of positions such as sitting, standing or kneeling. A pair of cavities on each portion of the watercraft provide leg and foot support accommodating a user in a variety of positions. Zigurs in U.S. Pat. No. 5,649,498, the disclosure of which is incorporated herein by reference, provides a dual hull kayak that has a frame assembled from a variety of frame segments that attaches to a pair of hulls. The Zigurs reference shows a fairly standard configuration for dual hulled kayaks. Although the frame segments are sometimes not as rigid, they are nonetheless fairly stable in calm waters. Furthermore, the frame segments are fairly inexpensive and can be disassembled for shipping. Unfortunately, the frame segments are more difficult to clean after use.

While a variety of dual hulled kayaks have been provided in the prior art, the current state-of-the-art lacks a highly maneuverable, yet strong and light design for a dual hulled kayak.

SUMMARY OF THE INVENTION

The present invention is a dual hull kayak that has a right pontoon that is substantially hollow and having a right forward end and a right rear end so that in ordinary buoyancy the right pontoon substantially supports the dual hull kayak from the right forward end to the right rear end. Also, a left pontoon that is substantially hollow and having a left forward end and a left rear end allows in ordinary buoyancy the left pontoon to substantially support the dual hull kayak from the left forward and to the left rear end. A bridge arch is formed between and joins the right pontoon and left pontoon. The bridge arch further comprises a shallow depression for supporting a user. The bridge arch is substantially hollow and the right forward end, the right rear end protrude from the bridge arch. Similarly, the left forward end and the left rear end protrude from the bridge arch so that, since the right forward end and the left forward end are substantially parallel, the dual hull kayak is 'H' shaped.

A top portion formed of a top main bidirectional fiberglass layer, a top fiberglass matting layer bonded to the top main bidirectional fiberglass layer, a top exterior gelcoat layer covering the top fiberglass matting layer, and a top resin bonding the top main bidirectional fiberglass layer to the top fiberglass matting layer. The top portion forms the depressed platform for a user. A bottom portion is formed of a bottom main bidirectional fiberglass layer. A bottom fiberglass matting layer is bonded to the bottom main bidirectional fiberglass layer. A bottom exterior gelcoat layer covers the bottom fiberglass matting layer. A bottom resin bonds the bottom main bidirectional fiberglass layer to the bottom fiberglass matting layer. The bottom portion forms the bridge arch. A foam layer is preferably injected between the bridge arch and the depressed platform so that the bridge arch supports the foam layer which in turn supports the depressed platform which in turn supports the user.

DETAILED DESCRIPTION OF THE PREFERRED EMBODIMENT

Figure 1:
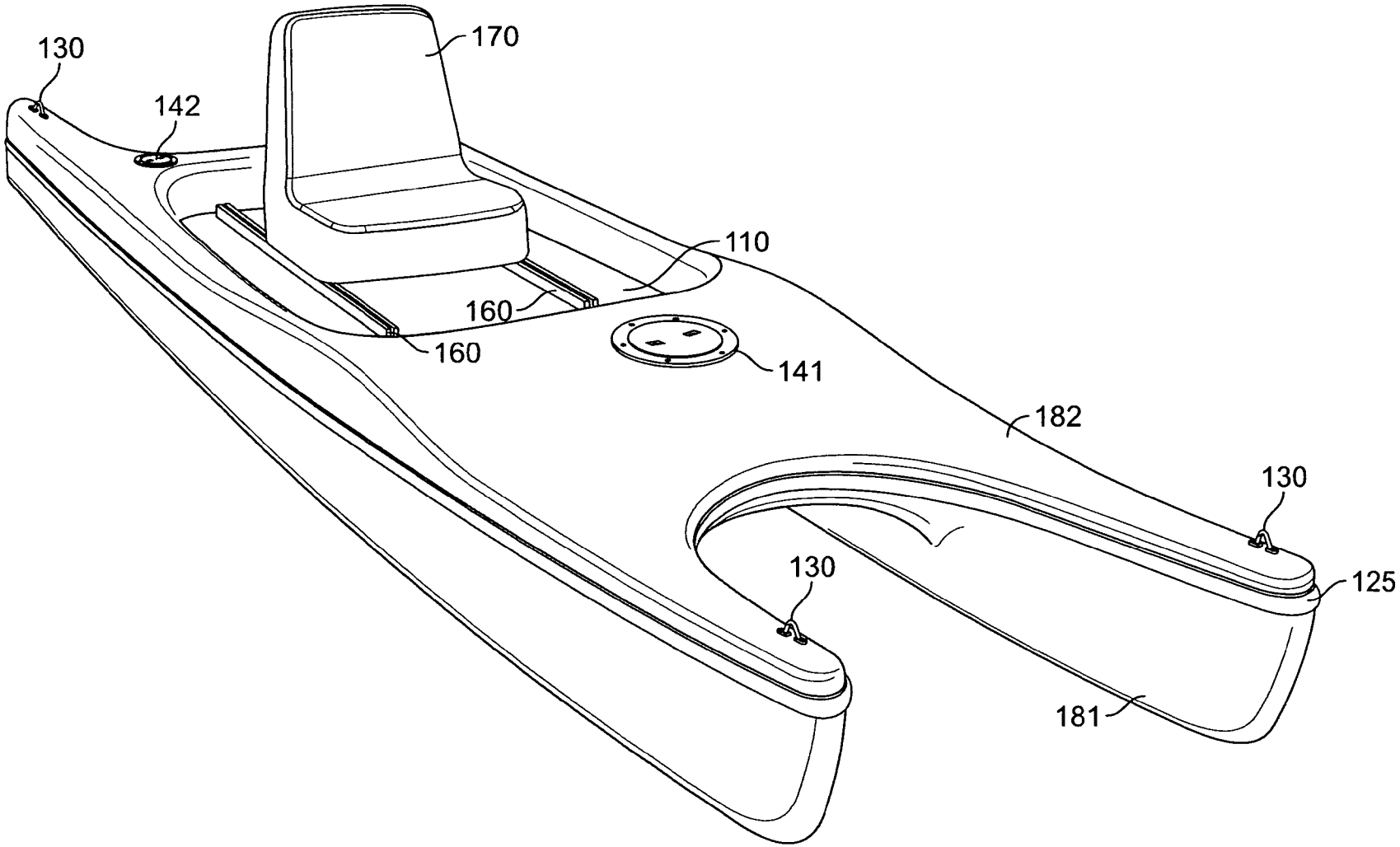
FIG. 1 is a perspective view of the dual hulled kayak.
Figure 2:
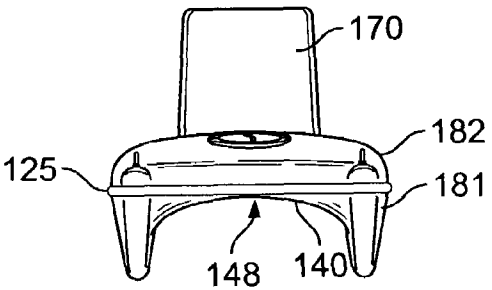
FIG. 2 is a front view of the kayak.
Figure 3:
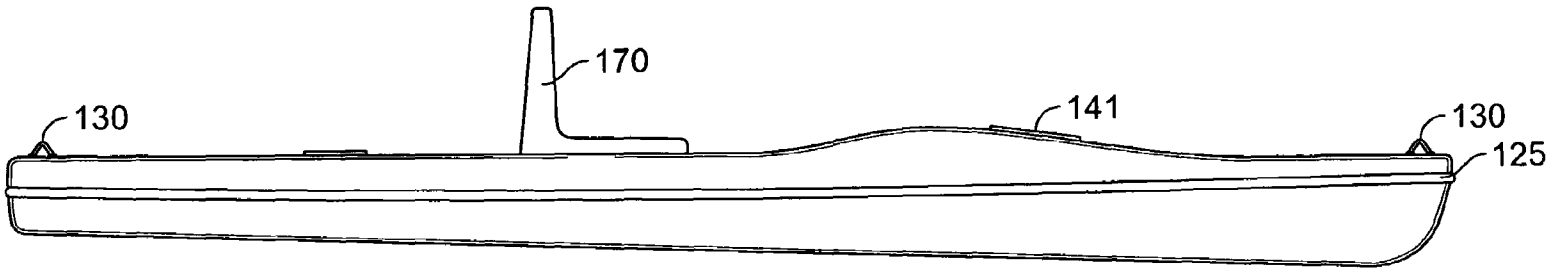
FIG. 3 is a right side view, with the left side substantially a mirror image of the right side view.
Figure 6:
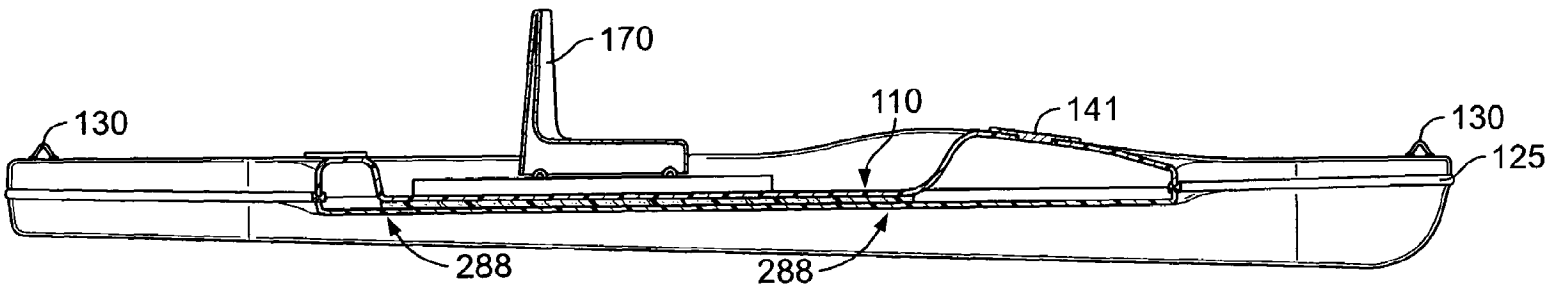
FIG. 6 is a side cross section view.
Figure 4:
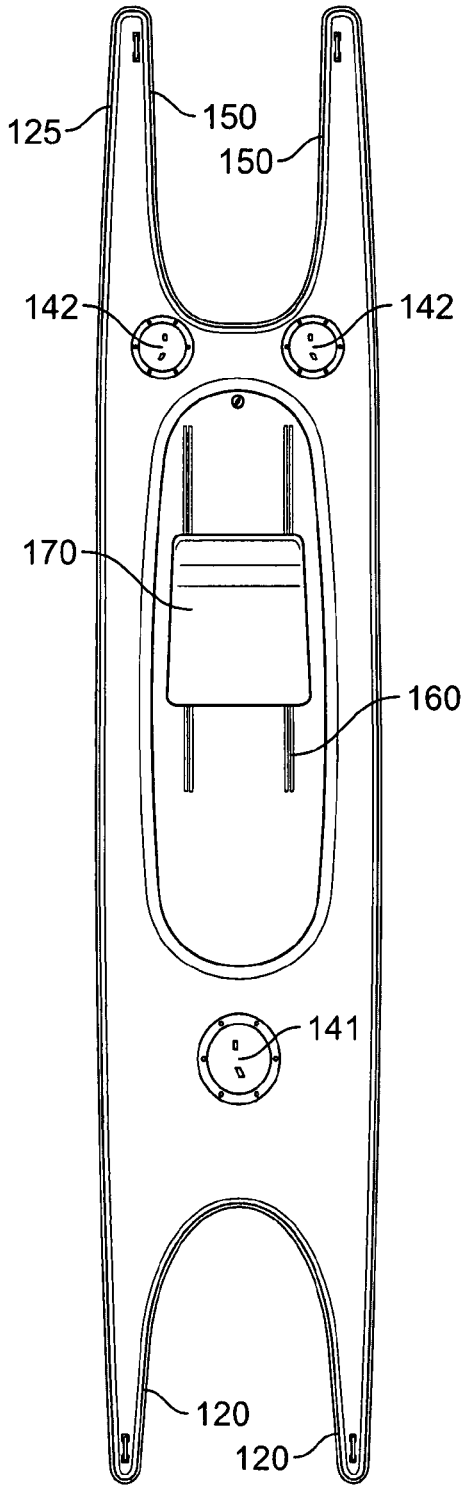
FIG. 4 is a top view.
Figure 5:
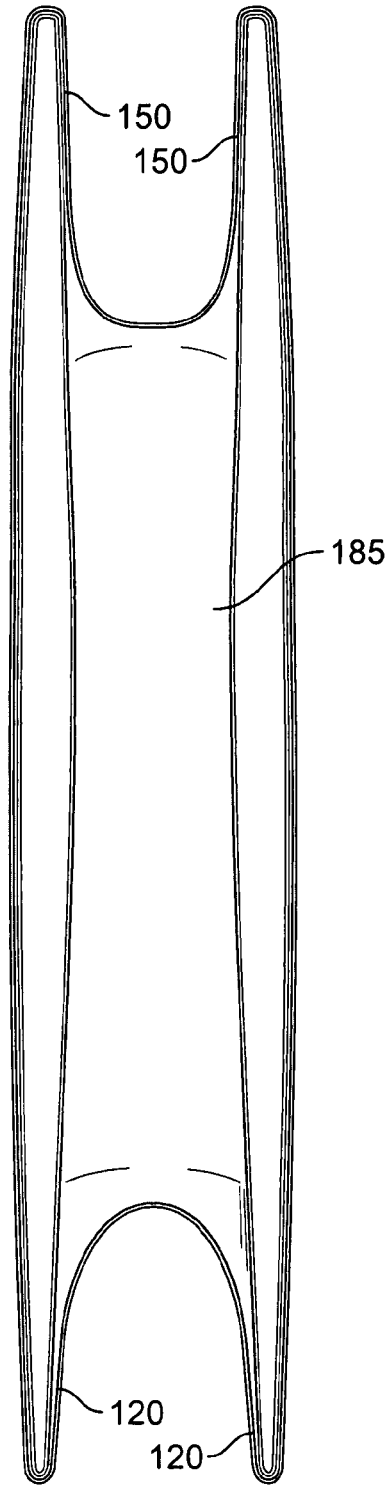
FIG. 5 is a bottom view.
Figure 7:
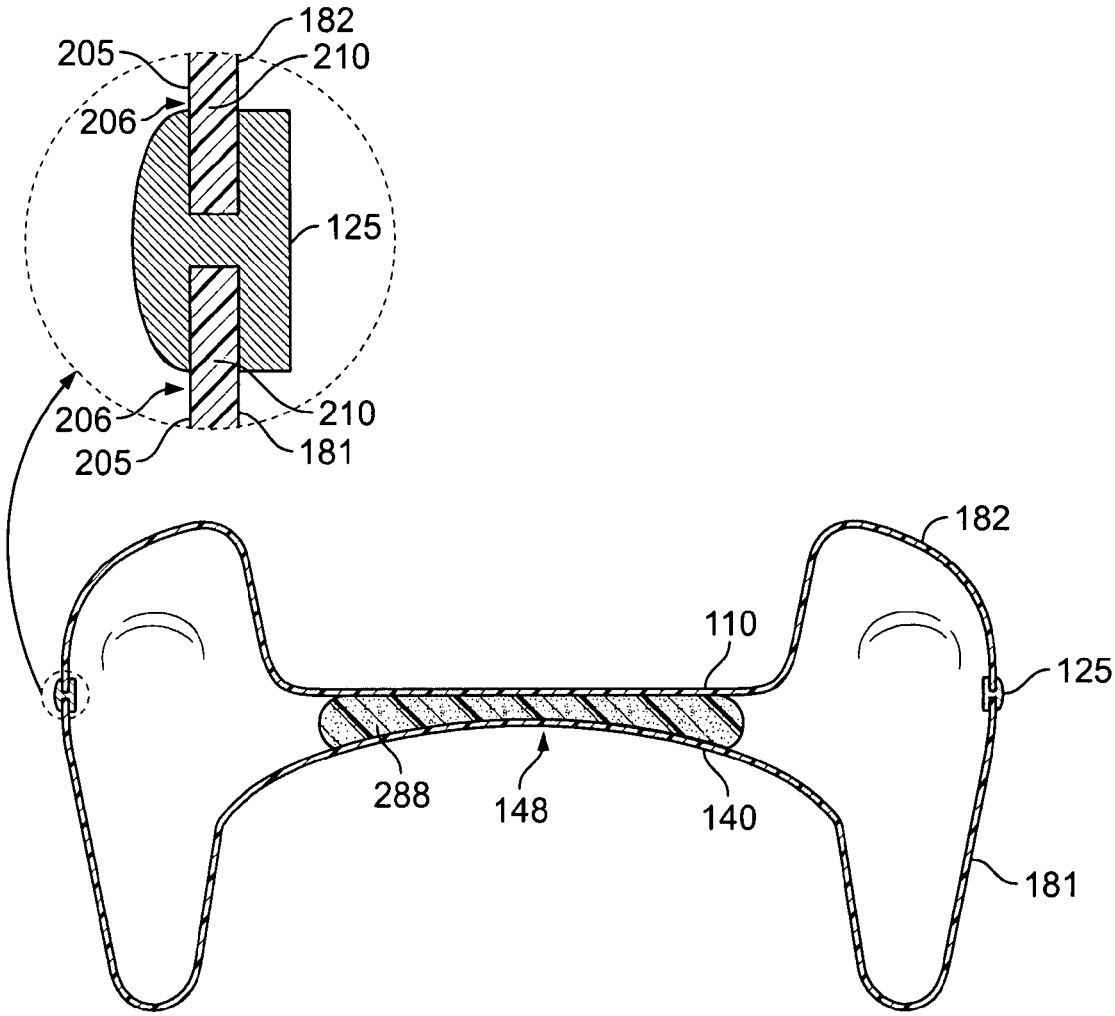
FIG. 7 is a front cross section view.

The construction of the kayak is preferably made of fiberglass that is multi-directional and molded in an upper section 182 that is joined with a lower section 181 so that the body of the kayak is substantially hollow. A single layer of fiberglass can be used. For extra rigidity, an extra second fiberglass layer can be added on top of the first layer. The bottom section preferably has a bottom surface of gel coat which is a thin resin-based pigment layer. The gel coat 206 is applied to 1.5 ounce fiberglass matting 205 that has multiple directions and orientations. The fiberglass matting 205 layer is bonded to a 17 ounce linear bidirectional oriented 45° or 90° main fiberglass layer or standard woven fiberglass. A polyester resin such as that of the Hydrex™ brand is used to bond the fiberglass layers. With the compound curves of the dual hull kayak, a laminate of fiberglass matting 205 and a single fiberglass layer 210 of 17 ounce linear bidirectional is sufficient to maintain rigidity when the upper section is bonded to the lower section. Although 17 ounce linear bidirectional is preferred, the density can vary by 20% from this.

The upper section preferably has an upper layer of paint which is a gel coat similarly constituted as that of the gel coat applied to the lower section. The gel coat is applied to the 1 ounce fiberglass matting having multiple directions and orientations. The fiberglass matting is applied to the main fiberglass layer of 17 ounce linear bidirectional oriented 45° or 90° main fiberglass layer. A 45° layer has orientation preferably longitudinally along the length of the hull.

Between the upper section and the bottom section is a gap portion that is preferably filled with polyurethane foam having a density of approximately 2 pounds. The upper section and lower section join so that the depressed platform 110 is approximately 1 inch above the bridge apex 148 at the apex and approximately 3 inches to where the foam is discontinued. Therefore, the foam substantially covers most of the depressed platform 110 providing a support for the depressed platform 110 upon the arch shaped bridge 140. The foam 288 is typically injected on one side of the upper or lower section. Then the upper section is bonded to the lower section and squeezes the foam so that it is generally applied to support most of the depressed platform 110.

A joining strip 125 joins the upper section 182 to the lower section 181. The joining strip 125 is also called a rub rail because it protects the watercraft from rubbing against objects. The upper section 182 is adhered to the lower section 181 by epoxy or related adhesive. Alternatively, the fiberglass upper section and lower section can be replaced with plastic upper and lower sections. If made of plastic, the entire kayak body can be made of a single injection molded piece of plastic. However, in the preferred method of construction being the fiberglass two-piece construction, the joining strip has an 'H' shaped cross-section which defines a top groove to receive the upper section. The joining strip also has a bottom groove to receive the lower section. The joining strip has a portion passing between the upper section 182 and the lower section 181 to provide a cushion between the upper section 182 and the lower section 181. The joining strip 125 is preferably made of an elastomeric polymer such as a polyolefin, elastomer, or like material, optionally metal or metal reinforced. The upper and lower groove are substantially symmetrical and similarly sized.

Portions of the hollow body can be filled with foam for additional and selective support. The bridge 140 for example has a front opening 141 providing access to a cavity that lies between the lower section 181 and the depressed platform 110 portion of the kayak top section 182. The area between the lower section 181 and depressed platform 110 can be filled with a foam such as a expended polystyrene, or polyurethane foam to provide support between the bottom section 181 and the depressed platform 110. Preferably, the foam is injected underneath mounting rails 160. A seat back 170 can be mounted on top of the mounting rails 160.

The bottom section 181 arches upward to support load exerted downward on mounting rails 160. The bottom section 181 and the top section 182 has a total volume and buoyancy so that the bottom section 181 has an apex also called a bridge apex 148 at a middle of the kayak 185 which does not touch the water during normal user usage. The bridge 140 has a rounded bridge front 146 having a radius profile extending over of the top of the bridge 140 and tapering downward toward the front of the kayak. Assuming a user is approximately 200-350 pounds including equipment, the kayak has an appropriately calculated total volume and buoyancy.

A rear hatch 142 provides access to the interior hollow of the kayak. The rear hatch 142 can be watertight to prevent entry of water into the hollow portion of the kayak. The rear hatch 142 the rear of the kayak is substantially similar to the front hatch 141. The hatch 141, 142 has six screws that attach the hatch to the kayak body. The hatch is preferably made of a plastic that is corrosion resistant and watertight. A user may open and close the hatch manually via a handle on the hatch.

The kayak has a pair of forward protrusions 120 and a pair of rear protrusions 150. The forward protrusions 120 preferably lie parallel to each other and are parallel to the rear protrusions 150. In case of user mass being shifted to one side of the depressed platform 110, the protrusions 120, 150 provide additional stability toward the edge of the depressed platform 110.

Looking at the top view of the present invention watercraft, the right and left pontoon are supported by the bridge 140 which has a depressed platform 110. The right and left pontoon have forward and rear ends that protrude in parallel from the depressed platform so that the general shape of the watercraft is shaped like a letter 'H'. The 'H' shaped watercraft has in regular buoyancy, the right and left pontoon in the water while the bridge 140 is dry not touching the water.

As an alternative to the double piece construction, a single piece construction can also be implemented. Injection molded plastic is one way to implement a single piece construction. Although the dual hull kayak is preferably made of fiberglass for superior performance, it can also be made of injection molded plastic. Rotational injection molded plastic kayaks have been made and there are a wide variety of references related to rotational injection molded watercraft.

In either situation, the watercraft has a progressive compound curvature on the upper and lower sections so that there is no flat area except for the depressed platform 110. The upper and lower sections are therefore substantially convex in shape. Preferably, the right pontoon, left pontoon and bridge arch comprise a hull section that has compound curves over substantially all of the exterior surface except for the flat shallow depression.

As a user passes through the water, connecting loops 130 allow towing of floating articles, or attachment of equipment.

CALLOUT LIST OF ELEMENTS

110 Depressed Platform
120 Forward Protrusion
125 Joining Strip
130 Connecting Loop
140 Bridge
141 Front Opening
142 Rear Opening
148 Bridge Apex
150 Rear Protrusion
160 Mounting Rails
170 Seat Back
181 Kayak Bottom Section
182 Kayak Top Section
185 Middle Of Kayak
210 Bidirectional Fiberglass Layer
205 Fiberglass Matting Layer
206 Gel Coat
288 Foam

The invention claimed is:

1. A dual hull kayak comprising:

a. a top portion formed of a top main bidirectional fiberglass layer, a top fiberglass matting layer bonded to the top main bidirectional fiberglass layer, a top exterior gelcoat layer covering the top fiberglass matting layer, and a top resin bonding the top main bidirectional fiberglass layer to the top fiberglass matting layer; wherein the top portion forms a depressed platform for a user;

b. a bottom portion formed of a bottom main bidirectional fiberglass layer, a bottom fiberglass matting layer bonded to the bottom main bidirectional fiberglass layer, a bottom exterior gelcoat layer covering the bottom fiberglass matting layer, and a bottom resin bonding the bottom main bidirectional fiberglass layer to the bottom fiberglass matting layer; wherein the bottom portion forms a bridge arch;

c. a foam layer injected between the bridge arch and the depressed platform so that the bridge arch supports the foam layer which in turn supports the depressed platform which in turn supports the user.

2. The dual hull kayak of claim 1, further comprising a rub rail having a top groove a bottom groove, wherein the top groove receives the top portion and the bottom groove receives the bottom portion, wherein the rub rail joins the top portion and bottom portion to form a rigid hollow body.

3. The dual hull kayak of claim 1, wherein the main fiberglass layer is 17 ounce bidirectional of 45° orientation.

4. The dual hull kayak of claim 1, wherein the main fiberglass layer is approximately 17 ounce linear bidirectional of 90° orientation.

5. The dual hull kayak of claim 1, wherein the foam layer is polyurethane foam of approximately 2 pounds per cubic foot.

6. The dual hull kayak of claim 1, further comprising a rub rail having a top groove a bottom groove, wherein the top groove receives the top portion and the bottom groove receives the bottom portion, wherein the rub rail joins the top portion and bottom portion to form a rigid hollow body; wherein the main fiberglass layer is approximately 17 ounce linear bidirectional of 45° orientation.

7. The dual hull kayak of claim 1, further comprising a rub rail having a top groove a bottom groove, wherein the top groove receives the top portion and the bottom groove receives the bottom portion, wherein the rub rail joins the top portion and bottom portion to form a rigid hollow body; wherein the main fiberglass layer is approximately 17 ounce linear bidirectional of 45° orientation and wherein the foam layer is polyurethane foam of approximately 2 pounds per cubic foot.

8. A dual hull kayak comprising:

a. a right pontoon that is substantially hollow and has a right forward end and a right rear end so that in ordinary buoyancy the right pontoon substantially supports the dual hull kayak from the right forward end to the right rear end;

b. a left pontoon that is substantially hollow and has a left forward end and a left rear end so that in ordinary buoyancy the left pontoon substantially supports the dual hull kayak from the left forward and to the left rear end;

c. a bridge arch formed between and joining the right pontoon and left pontoon, wherein the bridge arch further comprises a shallow depression for supporting a user, wherein the bridge arch is substantially hollow, wherein the right forward end protrudes from the bridge arch, wherein the right rear end protrudes from the bridge arch, wherein the left forward end protrudes from the bridge arch, wherein the left rear end protrudes from the bridge arch, wherein the right forward end and the left forward end are substantially parallel so that the dual hull kayak is 'H' shaped;

d. mounting rails on the shallow depression;

e. a seat mounted to the mounting rails for user support wherein the right pontoon, left pontoon and bridge arch are made substantially of a main fiberglass layer approximately 17 ounce linear bidirectional of 45° orientation.

9. The dual hull kayak of claim 8, wherein the right pontoon, left pontoon and bridge arch are made substantially of injection molded plastic.

10. The dual hull kayak of claim 8, further comprising a rub rail having a top groove a bottom groove, wherein the top groove receives a top portion and the bottom groove receives a bottom portion, wherein the rub rail joins the top portion and bottom portion to form a rigid hollow body; wherein the main fiberglass layer is approximately 17 ounce linear bidirectional of 45° orientation and wherein the foam layer is polyurethane foam of approximately 2 pounds per cubic foot.

11. The dual hull kayak of claim 8, wherein a gap formed between the bridge arch and the shallow depression is approximately 1 inch.

12. The dual hull kayak of claim 8, wherein the right pontoon, left pontoon and bridge arch comprise a hull section that has compound curves over substantially all of the exterior surface except for the flat shallow depression.

13. A dual hull kayak comprising:

a. a right pontoon that is substantially hollow and has a right forward end and a right rear end so that in ordinary buoyancy the right pontoon substantially supports the dual hull kayak from the right forward end to the right rear end;

b. a left pontoon that is substantially hollow and has a left forward end and a left rear end so that in ordinary buoyancy the left pontoon substantially supports the dual hull kayak from the left forward and to the left rear end;

c. a bridge arch formed between and joining the right pontoon and left pontoon, wherein the bridge arch further comprises a shallow depression for supporting a user, wherein the bridge arch is substantially hollow, wherein the right forward end protrudes from the bridge arch, wherein the right rear end protrudes from the bridge arch, wherein the left forward end protrudes from the bridge arch, wherein the left rear end protrudes from the bridge arch, wherein the right forward end and the left forward end are substantially parallel so that the dual hull kayak is 'H' shaped;

d. a top portion formed of a top main bidirectional fiberglass layer, a top fiberglass matting layer bonded to the top main bidirectional fiberglass layer, a top exterior gelcoat layer covering the top fiberglass matting layer, and a top resin bonding the top main bidirectional fiberglass layer to the top fiberglass matting layer; wherein the top portion forms the depressed platform for a user;

e. a bottom portion formed of a bottom main bidirectional fiberglass layer, a bottom fiberglass matting layer bonded to the bottom main bidirectional fiberglass layer, a bottom exterior gelcoat layer covering the bottom fiberglass matting layer, and a bottom resin bonding the bottom main bidirectional fiberglass layer to the bottom fiberglass matting layer; wherein the bottom portion forms the bridge arch;

f. a foam layer injected between the bridge arch and the depressed platform so that the bridge arch supports the foam layer which in turn supports the depressed platform which in turn supports the user.

14. The dual hull kayak of claim 13, further comprising a rub rail having a top groove a bottom groove, wherein the top groove receives a top portion and the bottom groove receives a bottom portion, wherein the rub rail joins a top portion and a bottom portion to form a rigid hollow body.

15. The dual hull kayak of claim 13, further comprising a rub rail having a top groove a bottom groove, wherein the top groove receives the top portion and the bottom groove receives the bottom portion, wherein the rub rail joins the top portion and bottom portion to form a rigid hollow body; wherein the main fiberglass layer is approximately 17 ounce linear bidirectional of 45° orientation.

16. The dual hull kayak of claim 13, further comprising a rub rail having a top groove a bottom groove, wherein the top groove receives the top portion and the bottom groove receives the bottom portion, wherein the rub rail joins the top portion and bottom portion to form a rigid hollow body; wherein the main fiberglass layer is approximately 17 ounce linear bidirectional of 45° orientation and wherein the foam layer is polyurethane foam of approximately 2 pounds per cubic foot.

* * * * *